US007621800B1

(12) United States Patent
Liao

(10) Patent No.: US 7,621,800 B1
(45) Date of Patent: Nov. 24, 2009

(54) BELT GRINDING MACHINE WITH A BELT ADJUSTING DEVICE

(75) Inventor: Hsiu-Ching Liao, Taichung (TW)

(73) Assignee: J & T Machinery Co., Ltd., Taichung (TW)

( * ) Notice: Subject to any disclaimer, the term of this patent is extended or adjusted under 35 U.S.C. 154(b) by 0 days.

(21) Appl. No.: 12/210,189

(22) Filed: Sep. 13, 2008

(51) Int. Cl.
*B24B 23/06* (2006.01)

(52) U.S. Cl. ..... 451/297; 451/311

(58) Field of Classification Search ..... 451/296, 451/297, 303, 311, 489
See application file for complete search history.

(56) References Cited

U.S. PATENT DOCUMENTS 1,744,807 A * 1/1930 Schulte ..... 451/297
3,330,076 A * 7/1967 Copeland ..... 451/297
3,359,689 A * 12/1967 McCarty et al. ..... 451/355
5,357,714 A * 10/1994 Landhuis ..... 451/311

* cited by examiner

*Primary Examiner*—Robert Rose
(74) *Attorney, Agent, or Firm*—Banger Shia

(57) ABSTRACT

A belt grinding machine with a belt adjusting device utilizes a screw to radially push an inclined surface of a push rod to make the push rod move axially to push rollers of the belt grinding machine, and thus the belt winding around the rollers can be adjusted. In an outer cover of the belt grinding machine is defined a penetrating hole for allowing a screw to extend out therethrough, so as to improve the safety and convenience of operation and adjustment. Moreover, the belt grinding machine is provided with an emergency switch located correspondingly to the outer cover, when the outer cover is open, it will press the emergency switch of the housing and consequently cut off the power supply, so as to further improve the safety of the belt grinding machine.

2 Claims, 11 Drawing Sheets

BELT GRINDING MACHINE WITH A BELT ADJUSTING DEVICE

BACKGROUND OF THE INVENTION

1. Field of the Invention

The present invention relates to a machine tool using a polishing belt, and more particularly to a belt grinding machine with a belt adjusting device.

2. Description of the Prior Art

Sand paper is the simplest, the most common and useful tool for grinding and polishing, however, in the past, the user always utilizes the sand paper to perform a grinding operation by hands directly, therefore, the planeness of the object to be ground is more likely to be influenced by the skill of the user, or even the goods will be deformed by overgrinding, for example, a surface which is expected to be a flat surface is finally ground into an arc-shaped surface.

Therefore, an electric grinding tool, such as, a grinding wheel machine and a belt grinding machine, is developed. The belt grinding machine comprises a grinding belt winding around two rollers and a motor for driving one of the rollers to rotate, and then the grinding belt rotates the other roller, so as to perform grinding operation.

However, the rotary shafts of the rollers must be parallel to each other, such that the belt can work normally without deviation. The problem is that the belt grinding machine is driven by motor, which inevitably will cause vibration during operation, on top of that, various kinds of external conditions, such as the influence of tension of the belt, will cause displacement of the rotating shafts and make them unparallel, resulting in the deviation of the belt. Hence, it requires an adjusting device to adjust the belt and the rollers.

Presently, a belt grinding machine with such an adjusting device, as shown in FIG. 1, usually comprises a housing A which has an open side and in which is disposed a supporting rack B. Both ends of the supporting rack B are formed with a gap B1, and the gaps B1 are located opposite to each other. Both ends of a rotating shaft C1 of a roller C are received in the gaps B1 of the supporting rack B. A belt D winds around the roller C. The adjusting device E is disposed on the supporting rack B and is provided with a positioning piece E1 and an adjusting rod E2. The positioning piece E1 is fixed to the supporting rack B and is located adjacent to one of the gaps B1 of the supporting rack B. One end of the adjusting rod E2 is defined with outer threads E21 to be threaded with the positioning piece E1, an axial direction of the adjusting rod E2 is vertical to that of the roller C, and the other end of the adjusting rod E2 is provided with a control handle E22.

Referring to FIG. 2, when the roller C deviates, it will affect the belt D winding around the roller C. The adjusting rod E2 can be moved relative to the positioning piece E1 simply by rotating the adjusting rod E2 with the control handle E22 due to the cooperation of the outer threads E21 of the adjusting rod E2 and the positioning piece E1, as shown in FIG. 3, so that the adjusting rod E2 can push the rotating shaft C1 of the roller C to move the roller C, thus adjusting the belt D.

Referring to FIGS. 1-3 again, during the adjustment operation, since the conventional mechanism is not provided with an outer cover for the sake of adjustment, the worker is likely to be caught by the roller C or the belt D by accidentally touching them at a high speed rotation, causing injury.

The present invention has arisen to mitigate and/or obviate the afore-described disadvantages.

SUMMARY OF THE INVENTION

The primary objective of the present invention is to provide a belt grinding machine with a belt adjusting device which can adjust rollers and a belt of the belt grinding machine simply by rotating a screw that is exposed out of an outer cover, and can improve the safety and convenience of operation and adjustment.

The second objective of the present invention is to provide a belt grinding machine with a belt adjusting device which can further improve the safety of the belt grinding machine. When the outer cover is open, it will press an emergency switch of the housing and consequently cut off the power supply.

To achieve the objective of the present invention, the belt grinding machine of the present invention comprises the housing, a motor, a drive roller, two supporting racks, a driven roller, the belt, the outer cover and the adjusting device. The motor is disposed on the housing, and a shaft of the motor is inserted into the housing and the drive roller. The supporting racks are disposed in the housing, and both ends of the driven roller are disposed at the supporting racks. The belt winds around the drive roller and the driven roller. The outer cover is pivotally disposed at and covers one side of the housing. The adjusting device is disposed on the supporting rack opposite the outer cover and comprises a screw and a push rod. One end of the screw of the adjusting device is threaded with the supporting rack opposite the outer cover, and the other end of the screw is exposed out of outer cover. One end of the push rod is inserted into the supporting rack opposite the outer cover and is in the form of an inclined surface. The one end of the screw is a conical surface for abutting against the inclined surface of the push rod. Rotating the screw can make its conical surface push the push rod, so that the push rod will move axially to push the driven roller, and thus the driven roller and the belt winding around the driven roller can be adjusted driven roller when the outer cover covers the housing.

Moreover, the housing is provided with an emergency switch, when the outer cover is open, it will press the emergency switch of the housing and consequently cut off the power supply and stop the motor, so as to prevent injury to the user caused by accidentally touching the switch and starting the belt grinding machine when the outer cover is opened.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Referring to FIGS. 4-9, a belt grinding machine with a belt adjusting device in accordance with the present invention comprises a housing A, a motor M, a drive roller R, two supporting racks B, a driven roller T, a belt D, an outer cover F and an adjusting device O.

The housing A is provided with an emergency switch A1, a start switch A2 and a stop switch A3. One side of the housing A is an open side.

Figure 8:
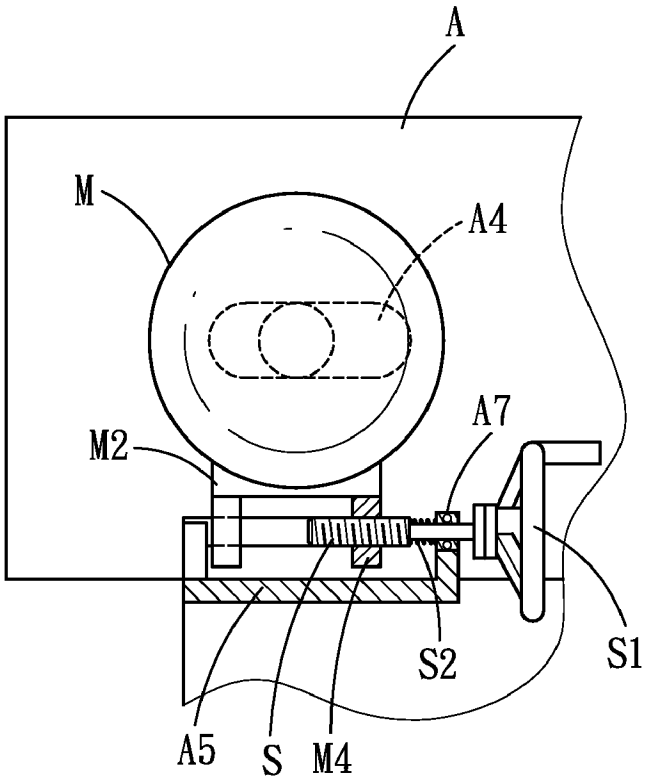
FIG. 8 is a side view of the motor after moving.
Figure 7:
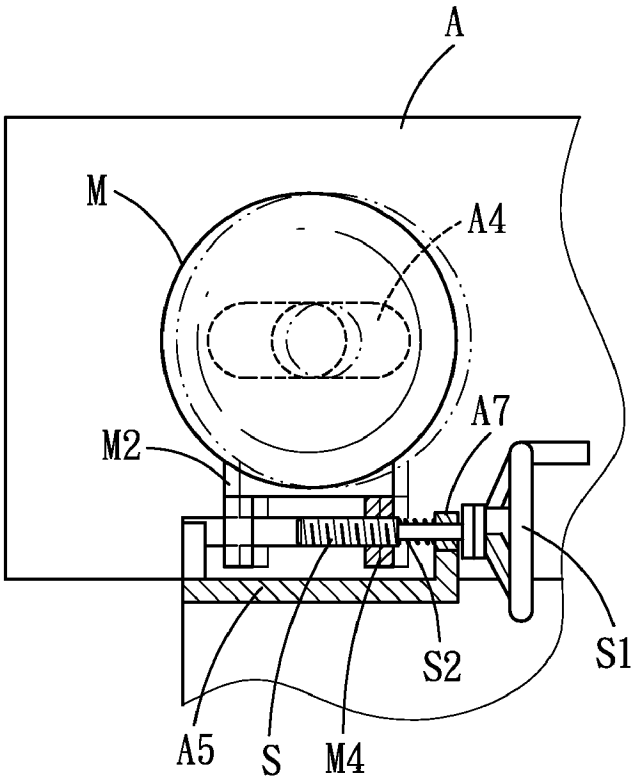
FIG. 7 is a side view of the motor before moving.
Figure 9:
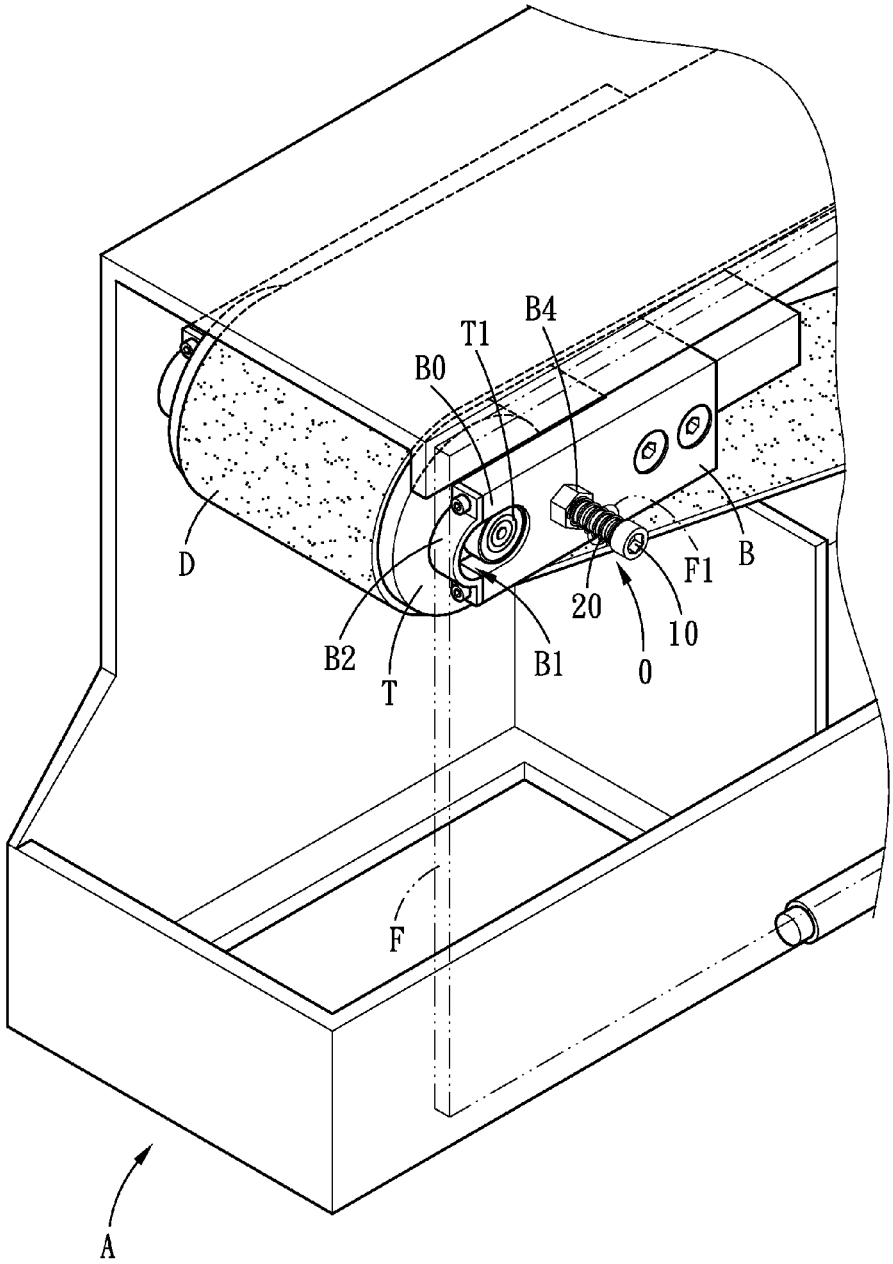
FIG. 9 is an illustrative view showing an adjusting device being disposed on a supporting rack.

The motor M is disposed at the other side of the housing A and is to be started and stopped by the start switch A2 and the stop switch A3, respectively. The housing A is defined with an elongated through hole A4 for insertion of a shaft M1 of the motor M. In the present embodiment, the housing A is provided with a carrying platform A5, and two guide rails A6 and a bearing A7 are disposed on the carrying platform A5. At a bottom of the motor M is provided a slide table M2. At a bottom of the slide table M2 is provided two sliding blocks M3 and a driving block M4, and the sliding blocks M3 are mounted on the guide rails A6 of the carrying platform A5. A threaded rod S has a threaded end threaded with the driving block M4 and a non-threaded end inserted into the bearing A7 of the carrying platform A5. An outer diameter of the threaded end of the threaded rod S is bigger than that of the non-threaded end. The non-threaded end of the threaded rod S is provided with a control dial S1 and is inserted in a spring S2. Both ends of the spring S2 are abutted against the bearing A7 and the threaded end of the threaded rod S, respectively. Referring to FIGS. 7 and 8, rotating the threaded rod S with the control dial S1 can make the driving block M4 move relative to the bearing A7, so that, with the cooperation of the guide rails A6 and the sliding blocks M3, the motor M can slide on the carrying platform A5.

The shaft M1 of the motor M is inserted into the drive roller R, so that when the motor M drives the shaft M1 to rotate, the drive roller R will be caused to rotate synchronously.

The supporting racks B are disposed in the housing A. One end of each supporting rack B is provided with two legs B0, and a gap B1 is formed between the legs B0 of each supporting rack B.

Both ends of the driven roller T are provided with a bearing T1 which is received in the gap B1 of the supporting rack B. A semicircle-shaped stopper B2 with both ends fixed to the legs B0 of each supporting rack B restricts the bearing T1 in the gap B1 of the respective supporting racks B.

The belt D winds around the drive roller R and the driven roller T and is provided with an abrasive surface for performing a surface grinding operation. Referring to FIGS. 7 and 8 again, when the motor M slides on the carrying platform A5 of the housing A, it will drive the drive roller R to move and change the distance between the drive roller R and the driven roller T, so that the tension of the belt D between the drive roller R and the driven roller T can be adjusted to adapt to various grinding operations. Referring to FIG. 8 again, during the adjustment of the motor M, if the tension of the belt D reaches its maximum value and makes the motor M unable to move anymore, rotating the threaded rod S will make it move out to compress the spring S2, so that the user can recognize that the tension of the belt D has reached its maximum value, so as to prevent the belt D from being damaged by excessive adjustment.

Figure 1:
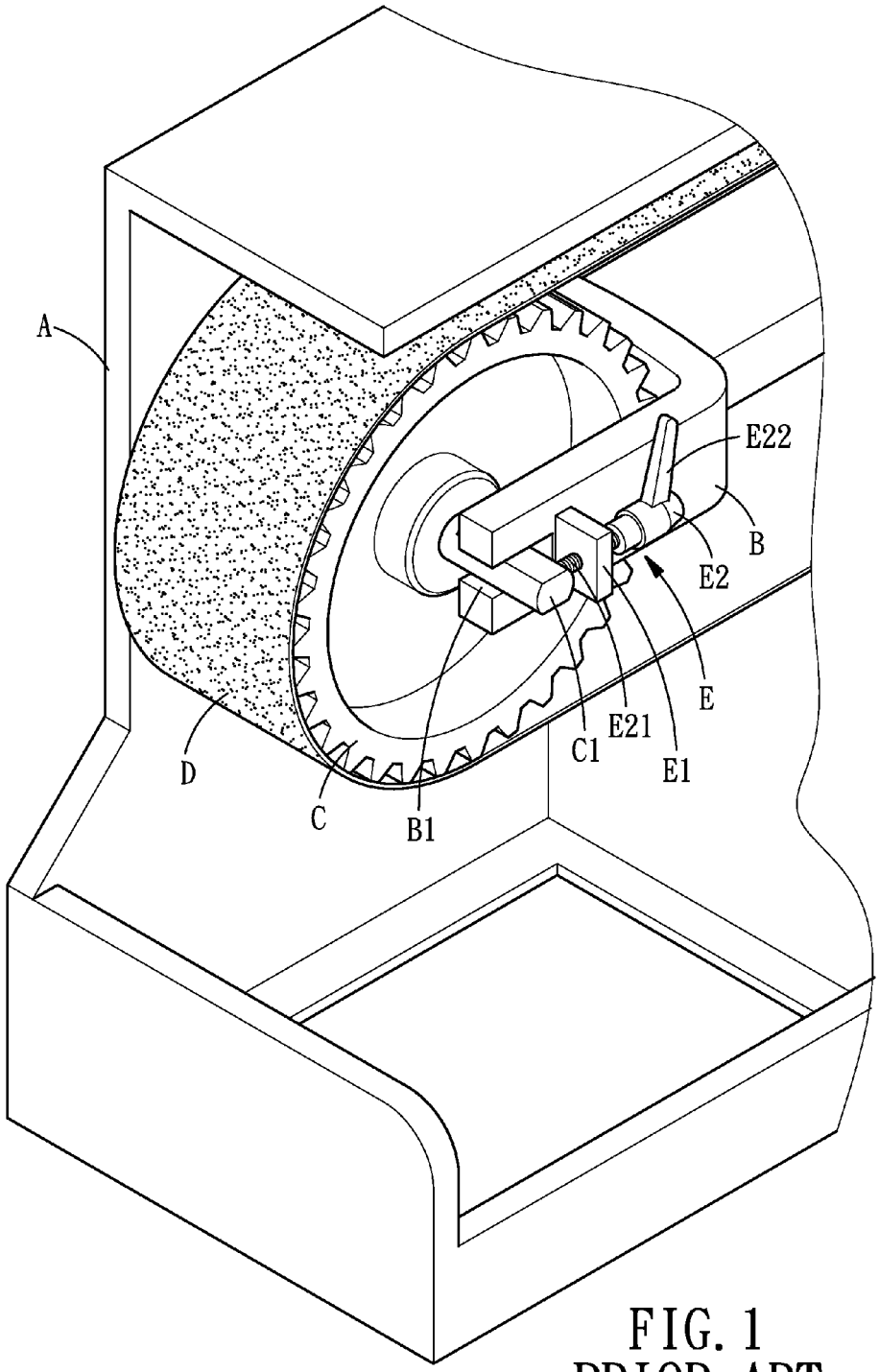
FIG. 1 PRIOR ART
FIG. 1 is an illustrative view showing an adjusting device being disposed on a conventional belt grinding machine.
Figure 2:
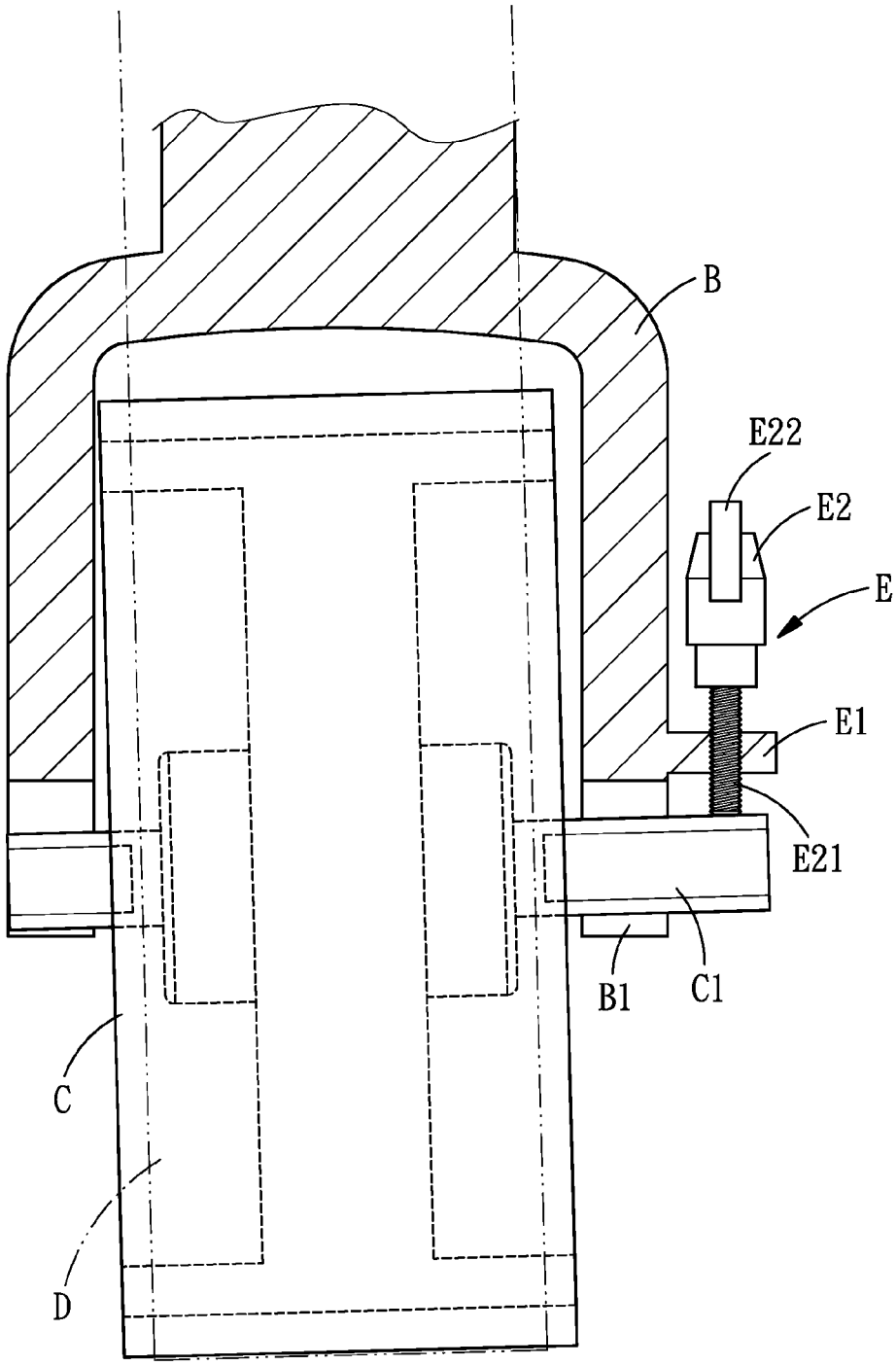
FIG. 2 PRIOR ART
FIG. 2 is an illustrative view showing the adjusting device being disposed on the conventional belt grinding machine and a roller being offset.
Figure 3:
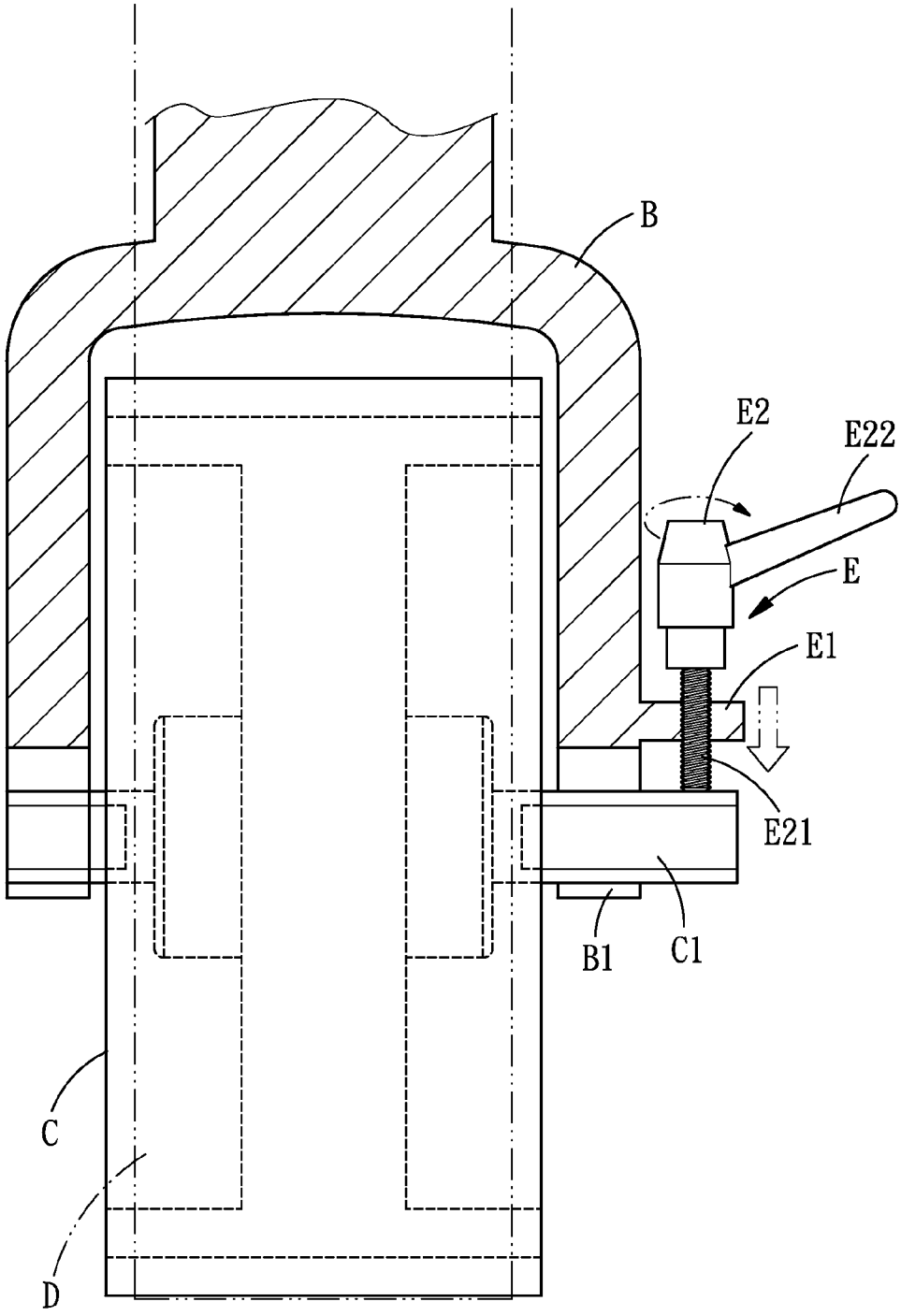
FIG. 3 PRIOR ART
FIG. 3 is an illustrative view showing an adjustment of the roller by the adjusting device of the conventional belt grinding machine.
Figure 4:
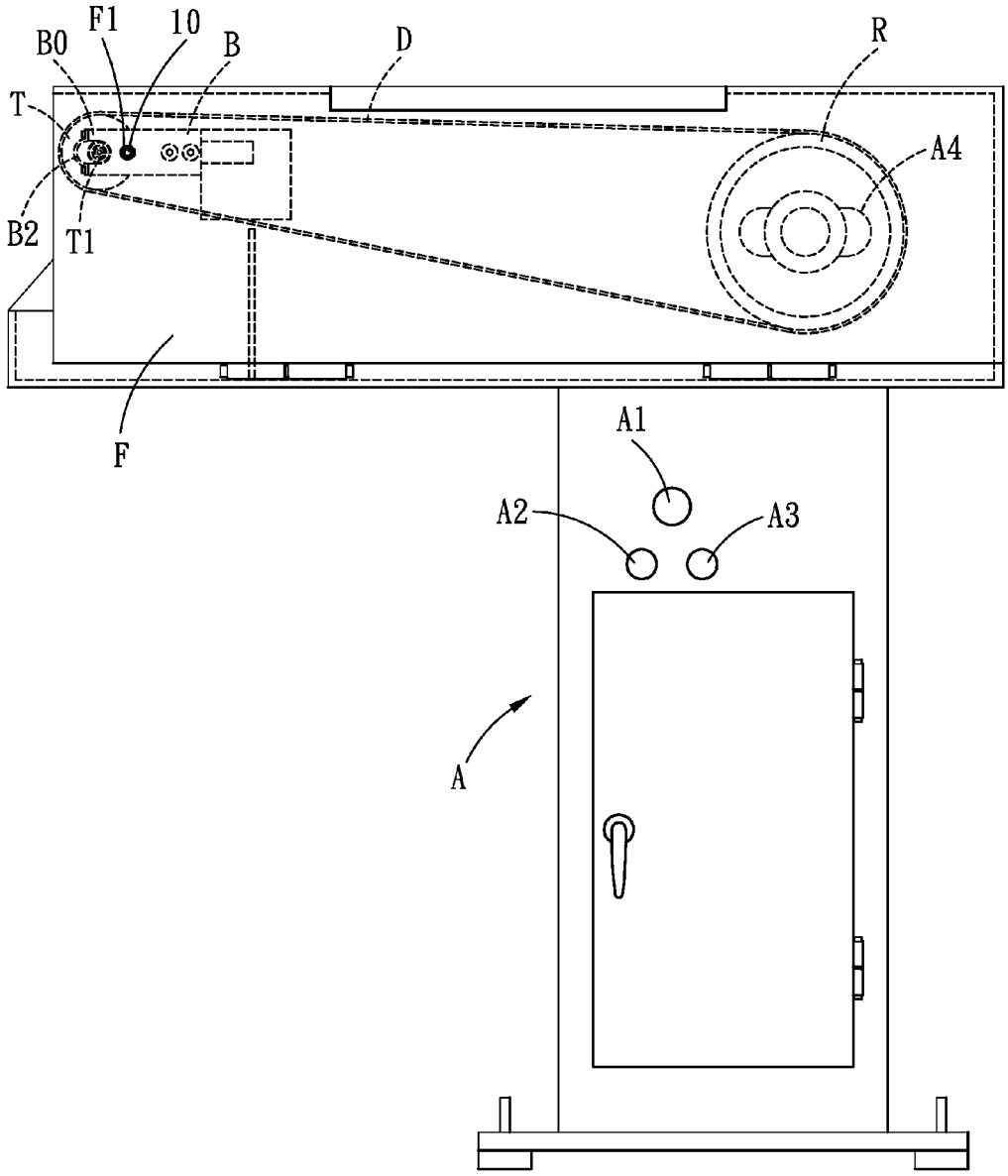
FIG. 4 is a side view of a belt grinding machine with belt adjusting device in accordance with the present invention.
Figure 5:
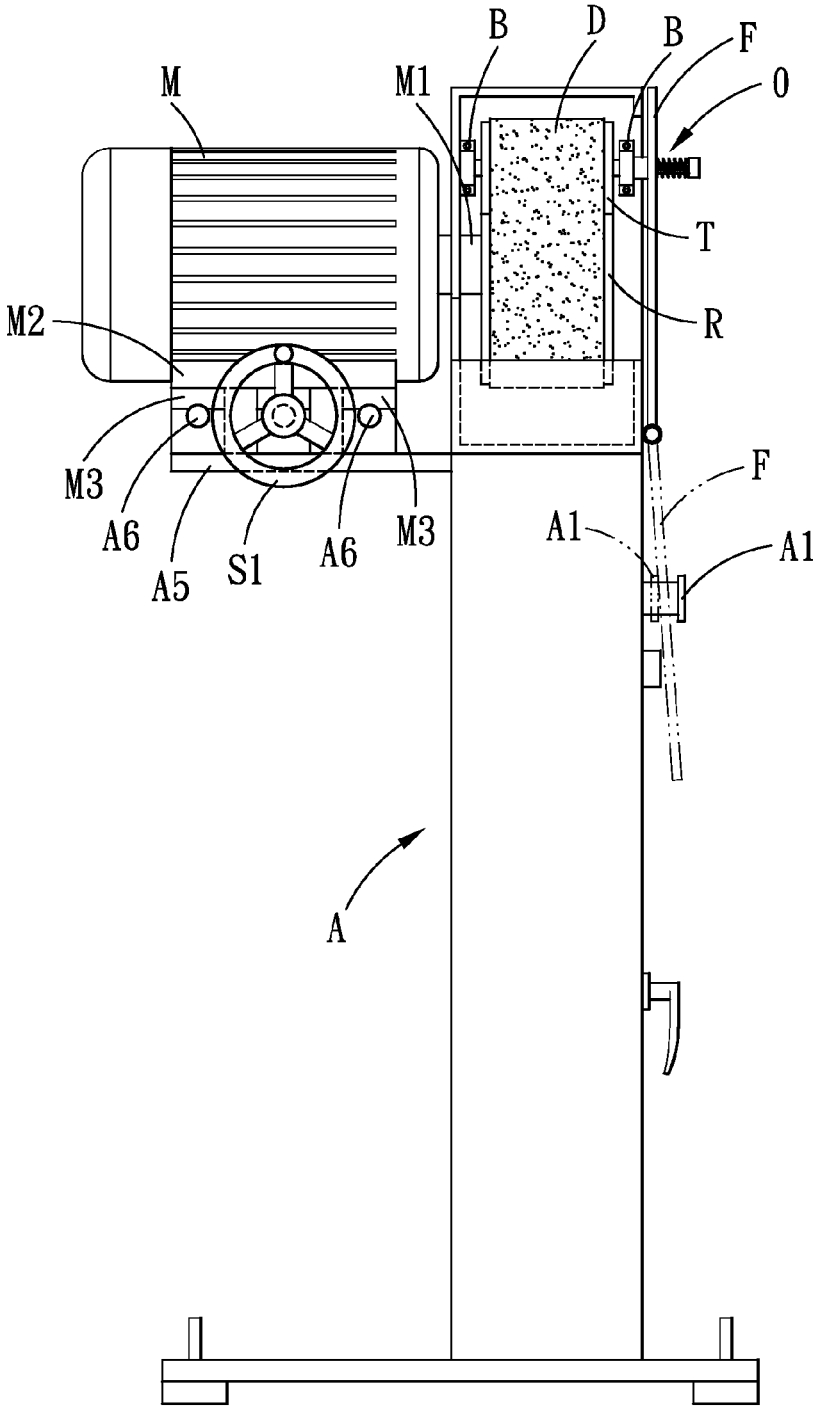
FIG. 5 is a front view of the belt grinding machine with belt adjusting device in accordance with the present invention.
Figure 6:
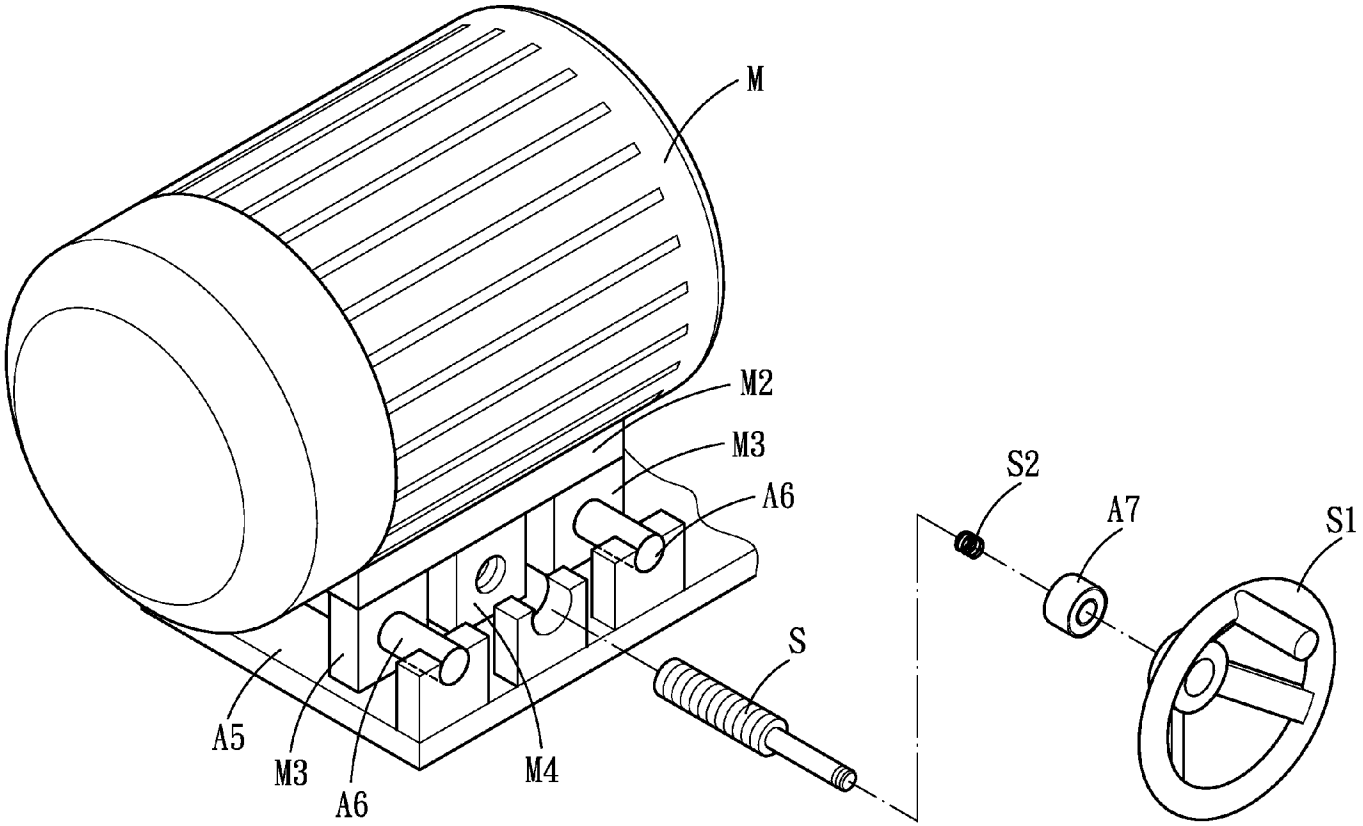
FIG. 6 is an illustrative view showing a motor being disposed on a housing of the belt grinding machine with belt adjusting device in accordance with the present invention.

The outer cover F is pivotally disposed at and covers the open side of the housing A. Referring to FIG. 5, when the outer cover F is open, it will press the emergency switch A1 of the housing A and consequently cut off the power supply, so as to stop the motor M.

Figure 10:
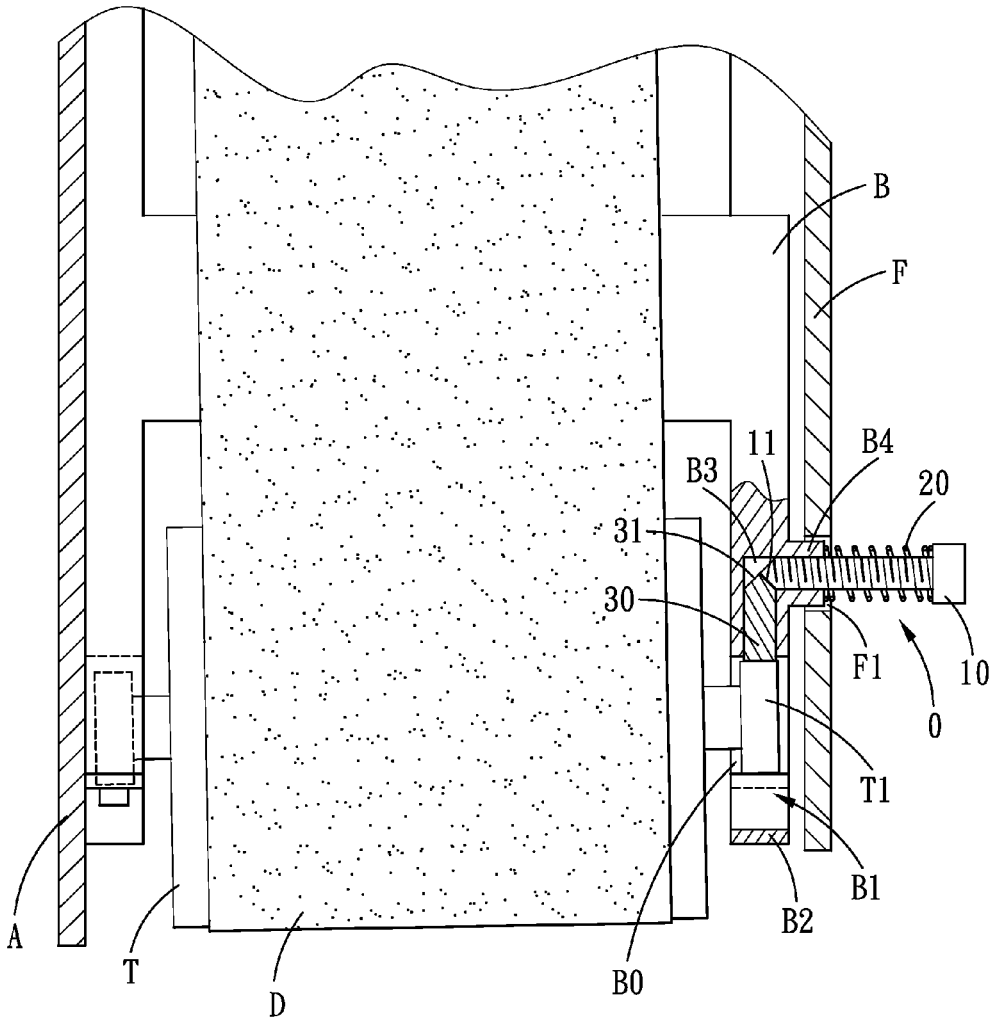
FIG. 10 is an illustrative view showing the adjusting device being disposed on the supporting rack and a driven roller being offset.
Figure 11:
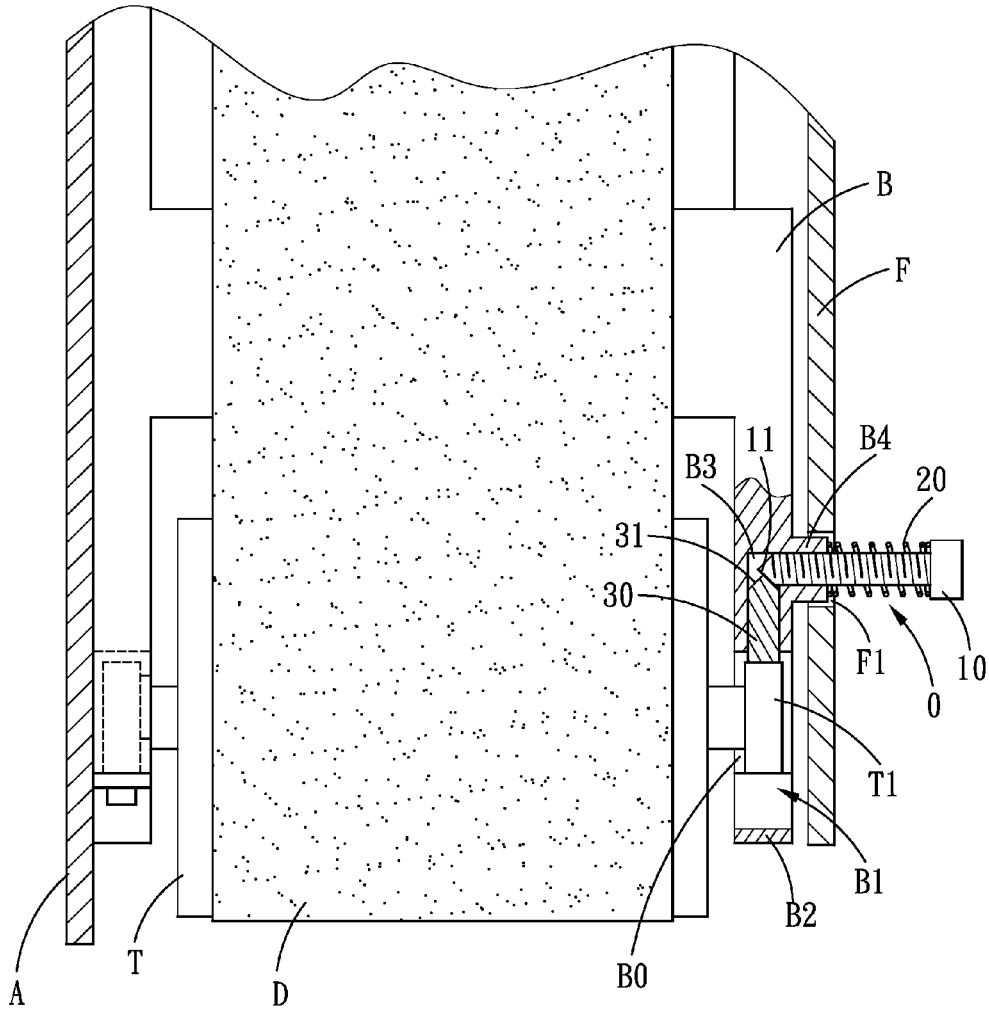
FIG. 11 is an illustrative view showing an adjustment of the driven roller by the adjusting device.

The adjusting device O is disposed on the supporting rack B opposite the outer cover F and comprises a screw 10, a spring 20 and a push rod 30, as shown in FIGS. 10 and 11. The supporting rack B opposite the outer cover F is defined with an L-shaped penetrated hole having a hole B3 with inner threads in one end thereof. One end of the hole B3 is defined in a lateral side of the supporting rack B opposite the outer cover F, a nut B4 is fixed to the lateral side of the supporting rack B and is in communication with the hole B3, and the other end of the hole B3 is in communication with the gap B1 of the supporting rack B opposite the outer cover F. The outer cover F is defined with a penetrating hole F1 located correspondingly to the hole B3. One end of the screw 10 with the spring 20 mounted thereon is threaded in the nut B4, and then is threaded in the hole B3, and the other end of the screw 10 is exposed out of the penetrating hole F1 of the outer cover F. The end of the screw 10 threaded in the hole B3 is a conical surface 11. One end of the push rod 30 is inserted into the hole B3 via the gap B1 and is in the form of an inclined surface 31 for abutting against the conical surface 11 of the screw 10, and the other end of the push rod 30 is protruded out of the supporting rack B opposite the outer cover F and is pressed against the bearing T1 located at one end of the driven roller T.

Figure 12:
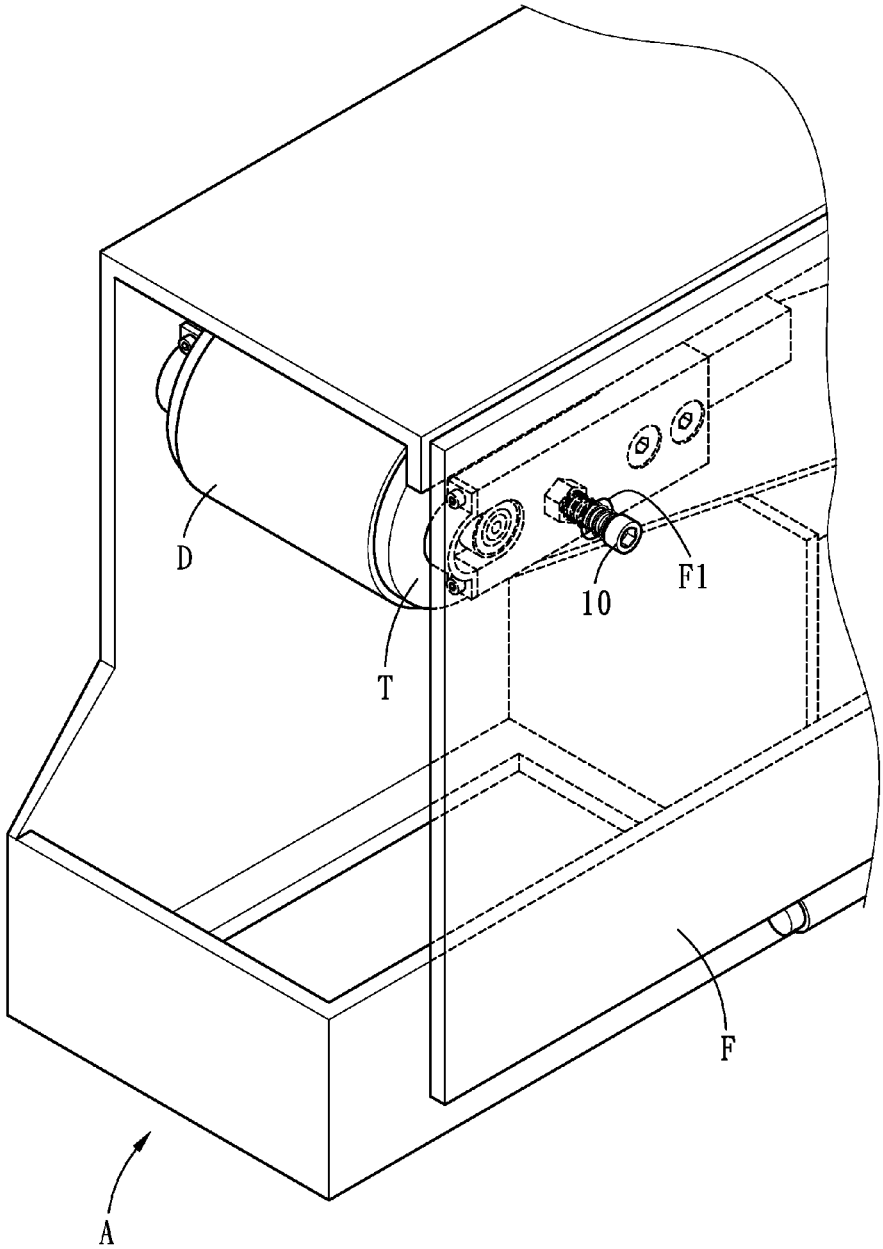
FIG. 12 is an illustrative view showing a screw being exposed out of an outer cover.

Referring to FIG. 10 again, when the driven roller T deviates, the user can rotate the screw 10 into the hole B3 of the supporting rack B without opening the outer cover F to make the conical surface 11 of the screw 10 push the inclined surface 31 of the push rod 30, so that the push rod 30 will move axially to push the bearing T1 of the driven roller T, as shown in FIG. 11, and thus the driven roller T and the belt D can be adjusted. It is apparent from the above-mentioned descriptions that when in use, since the screw 10 is exposed out of the penetrating hole F1 of the outer cover F, as shown in FIG. 12, the adjusting device O can be adjusted without detaching the outer cover F, such that the safety and convenience of operation and adjustment are largely improved.

Moreover, as described above, when the outer cover F is open, it will press the emergency switch A1 of the housing A and consequently cut off the power supply, so as to stop the motor M. That is to say, when the outer cover F is not tightly closed or is opened by the worker, the motor M will be stopped automatically, and the drive roller R and the driven roller T will also be stopped synchronously, so as to prevent injury to the user caused by accidentally touching the drive roller R or the driven roller T.

While we have shown and described various embodiments in accordance with the present invention, it should be clear to those skilled in the art that further embodiments may be made without departing from the scope of the present invention.

What is claimed is:

1. A belt grinding machine with a belt adjusting device, comprising:

a housing provided with a start switch and a stop switch for starting and stopping a motor, respectively, one side of the housing being open; the motor being disposed at the other side of the housing and disposed on a carrying platform, the housing being defined with an elongated through hole for insertion of a shaft of the motor; the shaft of the motor being inserted into a drive roller for driving it to rotate; two supporting racks being disposed in the housing, one end of each supporting rack being provided with two legs, a gap being formed between the legs of each supporting rack; a driven roller, both ends of which being received in the gaps of the supporting racks; a belt winding around the drive roller and the driven roller and being provided for performing a grinding operation; an outer cover being pivotally disposed at and covering the open side of the housing; and an adjusting device for adjusting a position of the belt;

characterized in that: the adjusting device is disposed on the supporting rack opposite the outer cover and comprises a screw having a conical surface, a nut and a push rod, the supporting rack opposite the outer cover is defined with a L-shaped penetrated hole having a hole with inner threads in one end thereof; the outer cover is defined with a penetrating hole located correspondingly to the hole having inner threads; one end of the screw of the adjusting device is firstly threaded in the nut, and then is threaded in the hole having inner threads, the other end of the screw is exposed out of the penetrating hole of the outer cover; one end of the push rod is inserted into the hole via the gap of the supporting rack opposite the outer cover and is in the form of an inclined surface for abutting against the conical surface of the screw, the other end of the push rod is protruded out of the supporting rack opposite the outer cover and is pressed against a bearing located at one end of the driven roller, rotating the screw makes its conical surface push the push rod, so that the push rod moves axially to push the driven roller, thus the driven roller is adjusted; a semicircle-shaped stopper with both ends fixed to the legs of each supporting rack restricts both ends of the driven roller in the gap of the respective supporting racks and allows the adjusting device to adjust a position of the driven roller; the housing is provided with an emergency switch, when the outer cover is open, it will press the emergency switch of the housing and consequently cut off the power supply, so as to stop the motor.

2. The belt grinding machine with a belt adjusting device as claimed in claim 1, wherein two guide rails and a bearing are disposed on the carrying platform, at a bottom of the motor is provided a slide table, at a bottom of the slide table is provided two sliding blocks and a driving block, the sliding blocks are mounted on the guide rails of the carrying platform, a threaded rod has a threaded end threaded with the driving block and a non-threaded end inserted into the bearing of the carrying platform, an outer diameter of the threaded end of the threaded rod is bigger than that of the non-threaded end, the non-threaded end of the threaded rod is provided with a control dial and is inserted in a spring, both ends of the spring are pressed against the bearing of the carrying platform and the threaded end of the threaded rod, rotating the threaded rod with the control dial makes the motor slide on the carrying platform, thus adjusting a tension of the belt.

* * * * *